US009528450B2

(12) United States Patent
Kurzenberger et al.

(10) Patent No.: US 9,528,450 B2
(45) Date of Patent: Dec. 27, 2016

(54) HAND-HELD POWER TOOL WITH AN INTERNAL COMBUSTION ENGINE

(71) Applicant: Andreas Stihl AG & Co. KG, Waiblingen (DE)

(72) Inventors: Jan Kurzenberger, Köngen (DE); Werner Gräter, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 158 days.

(21) Appl. No.: 14/277,869

(22) Filed: May 15, 2014

(65) Prior Publication Data

US 2014/0352660 A1 Dec. 4, 2014

(30) Foreign Application Priority Data

May 31, 2013 (DE) ..... 10 2013 009 154

(51) Int. Cl.

| | |
|---|---|
| ***F02D 11/02*** | (2006.01) |
| ***F02D 11/04*** | (2006.01) |
| ***B25D 17/00*** | (2006.01) |
| ***F02D 29/00*** | (2006.01) |
| ***F02M 1/02*** | (2006.01) |
| ***F02M 19/12*** | (2006.01) |
| *F02B 63/02* | (2006.01) |
| *F02D 9/02* | (2006.01) |

(52) U.S. Cl.

CPC ..... *F02D 29/00* (2013.01); *F02D 11/04* (2013.01); *F02M 1/02* (2013.01); *F02M 19/12* (2013.01); *F02B 63/02* (2013.01); *F02D 2009/0205* (2013.01); *F02D 2009/0208* (2013.01)

(58) Field of Classification Search

CPC .. F02D 11/04; F02D 29/00; F02D 2009/0205; F02D 2009/0208; F02M 1/02; F02M 19/12; F02B 63/02

USPC ..... 123/398, 400, 41.65; 173/162.2

See application file for complete search history.

(56) References Cited

U.S. PATENT DOCUMENTS

| | | | | |
|---|---|---|---|---|
| 5,209,196 | A | 5/1993 | Nickel et al. | |
| 5,215,049 | A | 6/1993 | Wolf | |
| 5,738,064 | A * | 4/1998 | Lowe | F02B 63/02 123/198 E |
| 6,848,405 | B1 | 2/2005 | Dow et al. | |

(Continued)

FOREIGN PATENT DOCUMENTS

| | | |
|---|---|---|
| DE | 43 11 256 B4 | 10/2004 |

*Primary Examiner* — Lindsay Low
*Assistant Examiner* — Syed O Hasan
(74) *Attorney, Agent, or Firm* — Gudrun E. Huckett

(57) ABSTRACT

A hand-held power tool has an internal combustion engine provided with a throttle trigger adjustable between an idle position and a full throttle position. The engine has an operating mode selector adjustable between an operating position and a start position. In an intake passage of the engine, a throttle element is arranged that is in a throttling position when the operating mode selector is in the start position. The throttle element is secured in the throttling position by a locking action. The locking action is released when the throttle trigger is moved from the idle position toward the full throttle position. A restoring element is coupled permanently to the position of the throttle trigger. The restoring element, when the throttle trigger is moved for releasing the locking action, acts on the operating mode selector and restores the operating mode selector from the start position into the operating position.

16 Claims, 4 Drawing Sheets

(56) References Cited

U.S. PATENT DOCUMENTS

| | | | | |
|---|---|---|---|---|
| 8,051,743 | B2 * | 11/2011 | Kullberg | B27B 17/08 123/398 |
| 8,511,650 | B2 | 8/2013 | Kern et al. | |
| 2001/0013664 | A1 | 8/2001 | Kobayashi | |
| 2010/0237515 | A1 | 9/2010 | Grater et al. | |
| 2010/0237516 | A1 * | 9/2010 | Kern | F02M 1/02 261/64.6 |

* cited by examiner

HAND-HELD POWER TOOL WITH AN INTERNAL COMBUSTION ENGINE

BACKGROUND OF THE INVENTION

The invention relates to a hand-held power tool with an internal combustion engine, comprising a throttle trigger and an operating mode selector, wherein the throttle trigger is adjustable between an idle position and a full throttle position and wherein the operating mode selector is adjustable between an operating position and a start position, wherein the internal combustion engine has an intake passage in which at least one throttle element is arranged, wherein the throttle element in the start position of the operating mode selector is in a throttling position, wherein the throttle element by means of a locking action is secured in the throttling position, and wherein the locking action is released upon actuation of the throttle trigger in the direction toward the full throttle position.

DE 43 11 256 B4 discloses a carburetor for an internal combustion engine of a motor chain saw in which, by means of an actuating lever, a start position is adjusted. In the start position a choke valve is completely closed and a throttle flap is partially closed. The throttle flap is secured by means of a locking action in the start position. For releasing the start position, the operator can return the choke valve by means of an operating lever into the completely open position. The throttle flap remains in its start position until the locking action is canceled by suppressing the throttle trigger.

U.S. Pat. No. 8,511,650 B2 discloses a carburetor assembly for a hand-held power tool. The power tool has a throttle trigger and an operating mode selector. By means of the operating mode selector, a throttle flap and a choke flap can be moved into a throttling position, i.e., a warm start position or a cold start position. The warm start position is released upon actuation of the throttle trigger in the direction toward its full throttle position. Upon release of the locking action, the operating mode selector is also returned into its operating position. This return action is realized by means of spring forces that are acting on the operating mode selector and on the choke flap. In order to enable a reliable return of the operating mode selector, these springs must be designed to be appropriately strong. This makes the selection of the start position more difficult because the operator must overcome the spring forces which are acting on the operating mode selector when selecting the start position. Depending on the arrangement of carburetor and operating mode selector, unfavorable leverage ratios for transmission of the forces may result.

SUMMARY OF THE INVENTION

It is an object of the present invention to provide a hand-held power tool with an internal combustion engine of the aforementioned kind that enables ergonomic handling.

In accordance with the present invention, this is achieved in that the hand-held power tool is provided with a restoring element that is coupled permanently to the position of the throttle trigger and that, upon actuation of the throttle trigger for releasing the locking action, acts on the operating mode selector and restores the operating mode selector from the start position into the operating position.

For restoring the operating mode selector, a restoring element is provided that is permanently coupled to the position of the throttle trigger. When the throttle trigger is actuated for release of the locking action, the restoring element is acting on the operating mode selector and restores the operating mode selector from the start position into the operating position. The operating mode selector is thereby not restored by means of spring forces acting on the operating mode selector and on the throttle element into the operating position, but instead by the restoring element as a result of the force applied by the operator on the throttle trigger. In this way, no great spring forces must be provided on the throttle element and on the operating mode selector. Even in case of unfavorable ratios of the leverage lengths of the coupling elements that transmit the spring forces acting on the throttle element onto the operating mode selector, a safe restoring action of the operating mode selector can be achieved. The coupling elements between the operating mode selector and the throttle element must not be designed for transmission of great forces so that a simple configuration and, as a whole, a low weight of the power tool will result.

Advantageously, the restoring element interacts with an actuating part which is connected to the operating mode selector. The restoring element is in particular pivotably supported on the throttle trigger and is resting on the actuating part. Due to the pivotable support of the restoring element on the throttle trigger, a constructively simple configuration results. The restoring element in this context is in particular a separate component that is pivotably supported on the throttle trigger. The restoring element can be advantageously also designed to be a monolithic part together with the throttle trigger, for example, when throttle trigger and restoring element are made of plastic material. By means of appropriate minimal wall thickness, elasticity of the connection of throttle trigger and restoring element and, in this way, a pivotability of the restoring element relative to the throttle trigger can be achieved. It may also be provided that the restoring element is arranged to be lengthwise slidable relative to the throttle trigger and is actuated, for example, by means of a cam or the like of the throttle trigger.

Advantageously, the restoring element is supported by spring action and is forced by the spring force against the actuating part. However, it may also be sufficient that the restoring element is resting under the force of gravity on the actuating element. This is advantageous in particular in case of power tools that are operating primarily in a predetermined operating position.

Advantageously, the actuating part has a restoring section and the restoring element, upon pivoting of the throttle trigger from the idle position in the direction toward the full throttle position, is acting on this restoring section and thereby restores the operating mode selector into its operating position. Since the restoring element is acting immediately on the restoring section of the actuating part, a beneficial force transmission via few elements results. The force which is exerted by the operator on the throttle trigger can be introduced by means of the restoring element immediately onto the operating mode selector.

When the throttle trigger pivots from the full throttle position into the idle position while the operating mode selector is in the start position, it is provided that the restoring element pivots and the restoring section is moved into the movement path of the restoring element along which the restoring element moves upon adjustment of the throttle trigger from the idle position into the full throttle position. Advantageously, the actuating part has a deflecting section which is resting in the operating position of the operating mode selector on the restoring element and which deflects the restoring element out of the movement path of the actuating part when the throttle trigger pivots from the idle position in the direction toward the full throttle position. In this way, in conventional operation, i.e., when the operating mode selector is in its operating position, it can be ensured that the movement of the throttle trigger is not impaired by the restoring element and the operating mode selector. The operating mode selector is advantageously adjusted into the start position when the throttle trigger is in the full throttle position. When the throttle trigger is then let go, the throttle trigger pivots into the idle position. Upon pivoting of the throttle trigger out of the full throttle position into the idle position, the restoring element pivots and the restoring section is moved into the movement path of the restoring element for adjustment of the throttle trigger out of the idle position into the full throttle position. In order to release the locking action of the throttle element, the operator must suppress the throttle trigger from the idle position (accelerate), i.e., must move the throttle trigger in the direction toward its full throttle position. In this way, the locking action is canceled. The locking action of the throttle element in the start position can be, for example, a locking action on a bearing shaft of the operating mode selector. When adjusting the throttle trigger from the idle position into the full throttle position, the restoring section of the actuating part is in the movement path of the restoring element. Upon acceleration for release of the locking action of the throttle element, the restoring element is acting on the restoring section and restores the operating mode selector accordingly into its operating position. Upon actuation of the throttle trigger from the locked position of the throttle element, i.e, from the idle position, in the direction toward the full throttle position, the operating mode selector is then restored into its operating position by means of the restoring element.

Advantageously, the deflecting section is lifted off the restoring element upon adjustment of the operating mode selector from the operating position into the start position. Accordingly, it is made possible in a simple way that the restoring element can pivot and that the restoring section is moved into the movement path of the restoring element. The actuating part has advantageously a contact section which deflects the restoring element when the throttle trigger is in its full throttle position and the operating mode selector is in its start position. Upon pivoting of the throttle trigger into the idle position, the restoring element advantageously slips off the contact section. In this way, it is ensured in a simple way that, for selecting the start position, the throttle trigger can be actuated into the full throttle position without being blocked by the restoring section of the actuating part. Since the restoring element slips off the contact section when the throttle trigger is pivoted, the restoring element is able to pivot such that the restoring section of the actuating part is positioned in the movement path of the restoring element.

A simple and robust configuration can be achieved when at least one lateral guide for the restoring element is provided. In case of a pivotable restoring element the lateral guide is advantageously positioned transversely to the longitudinal direction of the pivot axis of the restoring element. Expediently, two lateral guides for the restoring element are provided which are positioned opposite each other and guide the restoring element at both sides in the direction of the pivot axis.

Advantageously, in the intake passage a first throttle element and a second throttle element are arranged wherein both throttle elements are adjusted by means of the operating mode selector into a start position. Advantageously, one of the throttle elements is a throttle element that is actuated by the throttle trigger and the other throttle element is a choke element. Advantageously, the first throttle element is connected to a first coupling lever and the second throttle element is connected to a second coupling lever. In the start position of the operating mode selector, the two coupling levers are advantageously locked with each other and secure the throttle elements in their throttling position. Due to the locking action of the two coupling levers with each other, a simple constructive configuration results. Since no further elements are taking part in the locking action, the tolerances of the locking action can be maintained at a minimal level and the desired positions of the throttle elements in the start position can be adjusted comparatively precisely. The throttle trigger acts advantageously on the first throttle element and the operating mode selector on the second throttle element. The throttle elements can be advantageously throttle flaps or barrel-type throttle elements. The operating mode selector acts advantageously by means of an actuating lever on the second throttle element wherein the actuating lever has a first contact surface and a second contact surface. Upon pivoting of the operating mode selector from the operating position into the start position, the actuating lever advantageously is acting first by means of the first contact surface and then by means of the second contact surface on the second throttle element. The two contact surfaces are advantageously configured as flat surfaces and are positioned angularly relative to each other. In this way, the effective direction of the force, exerted by the operating mode selector by means of the actuating lever on the second throttle element, can be favorably introduced across the entire actuating range.

DESCRIPTION OF THE PREFERRED EMBODIMENTS

Figure 1:
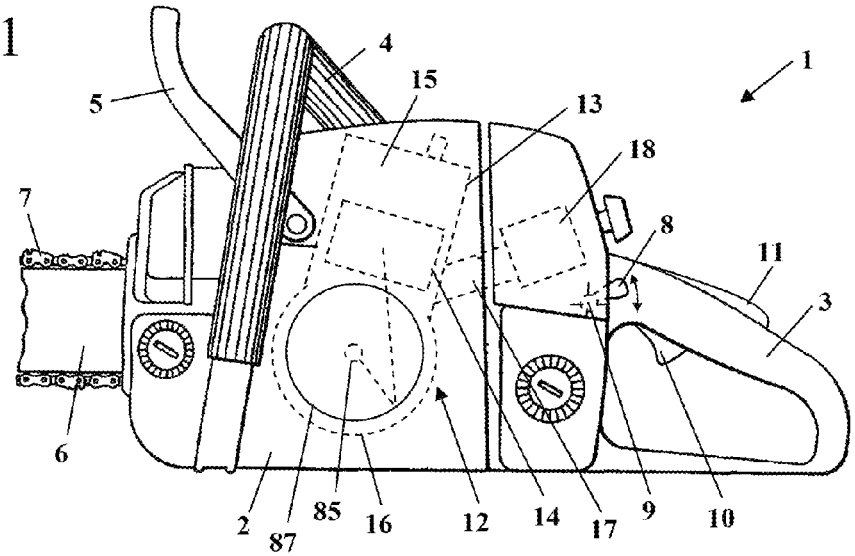
FIG. 1 is a schematic side view of a motor chain saw.

FIG. 1 shows a motor chain saw 1 as an embodiment of a hand-held power tool. Instead of the motor chain saw 1, a different type of hand-held power tool can be provided such as a cut-off machine, a trimmer, a suction/blowing device, a hedge trimmer, a harvesting device, or the like. The motor chain saw 1 has a housing 2 on which a rear handle 3 and a front handle (grip tube) 4 for guiding the motor chain saw 1 in operation are secured. On the side of the housing 2 which is opposite the rear handle 3, a guidebar 6 projects forwardly on which a saw chain 7 is arranged so as to circulate about the guidebar 6. On the housing 2, a hand guard 5 is arranged which is positioned on the side of the front handle 4 which is facing the saw chain 7. The hand guard 5 can be pivotably supported on the housing 2 and can serve for triggering a chain brake for the saw chain 7.

The saw chain 7 is driven in circulation by an internal combustion engine 12 arranged within the housing 2. The internal combustion engine 12 has a cylinder 13 in which a piston 14 is reciprocatingly supported. The piston 14 delimits a combustion chamber 15 which is formed within the cylinder 13. The piston 14 drives a crankshaft 85 which is rotatably supported in the crankcase 16. Supply of fuel/air mixture to the internal combustion engine 12 is accomplished by carburetor 18 that supplies fuel/air mixture to the internal combustion engine 12 by means of intake passage 17. Additionally, by means of carburetor 18 substantially fuel-free combustion air, in particular as scavenging air, can be provided also. For this purpose, the intake passage 17 is divided, advantageously downstream of the carburetor 18, into an air passage for supply of substantially fuel-free combustion air and into a mixture passage for supply of fuel/air mixture.

At the rear handle 3, a throttle trigger 10 and a throttle trigger lock 11 are pivotably supported. Adjacent to the rear handle 3 an operating mode selector 8 is pivotably supported about pivot axis 9 on the housing 2. The operating mode selector 8 serves for adjusting a start position for throttle elements in the carburetor 18. In the start position, the internal combustion engine 12 can be started by means of a starter device 87 that is schematically indicated in FIG. 1. The starter device 87 can be, for example, a cable starter or an electrically actuated starting device.

Figure 2:
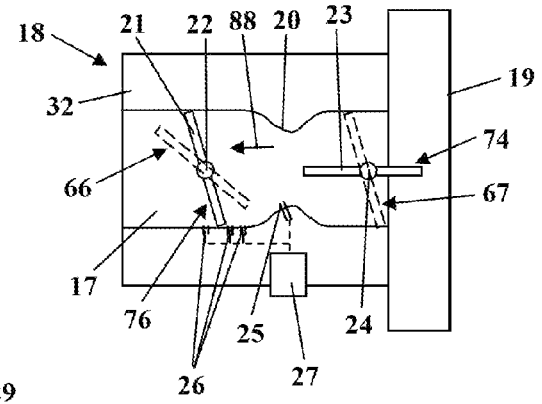
FIG. 2 is a schematic illustration of a carburetor of the motor chain saw of FIG. 1.

FIG. 2 shows schematically the configuration of the carburetor 18 and of an air filter 19. Relative to a flow direction 88 toward the internal combustion engine 12, the air filter 19 is arranged upstream of the carburetor 18. The carburetor 18 has a carburetor housing 32 in which a section of the intake passage 17 is formed. In the intake passage 17 a first throttle element 21 and a second throttle element 23 are pivotably supported. In the embodiment, the throttle elements 21 and 23 are designed as flaps. The throttle elements 21 and 23 can also be of a barrel design. Other configurations of the throttle elements 21 and 23 may be advantageous also. In the flow direction 88 between the throttle elements 21 and 23 in the intake passage 17 a venturi 20 is formed. In the area of the venturi 20, a main fuel opening 25 opens into the intake passage 17 by means of which fuel is supplied to the intake passage 17. Downstream of the venturi 20 in the area of the first throttle element 21 several auxiliary fuel openings 26 open into the intake passage 17. For supply of fuel, the carburetor 18 has a valve 27 that is formed preferably as a solenoid valve. However, the carburetor 18 can also be a conventional diaphragm carburetor with a mechanically acting inlet valve opening into the control chamber.

The first throttle element 21 is pivotably supported by means of a throttle shaft 22. In the non-activated state, the first throttle element 21 is in an idle position 76. In this idle position 76, the rim of the throttle flap which forms the first throttle element 28 is contacting or resting on the wall of the intake passage 17. The first throttle element 21 is closed in the idle position 76. The first throttle element 21 is spring-loaded by a spring, not shown, in the direction of the idle position 76. The first throttle element 21 has also a throttling position 66 in which the first throttle element 21 is partially open relative to the idle position 76. The throttling position 66 is indicated in dashed lines in FIG. 2. The second throttle element 23 has a non-actuated position 74 in which the second throttle element 23 is open. In the illustrated embodiment, the choke flap which forms the second throttle element 23 in the non-actuated position 74 is approximately parallel to the flow direction 88 in the intake passage 17. The second throttle element 23 is supported pivotably with a choke shaft 24. The second throttle element 23 has a throttling position 67 in which the second throttle element 23 at least partially closes off the flow cross-section in the intake passage 17. In the illustrated embodiment, the rim of the flap which forms the second throttle element 23 is resting on or contacting the wall of the intake passage 17. The second throttle element 23 is closed in this position. However, the second throttle element 23 may be partially open in its throttling position 67.

Figure 3:
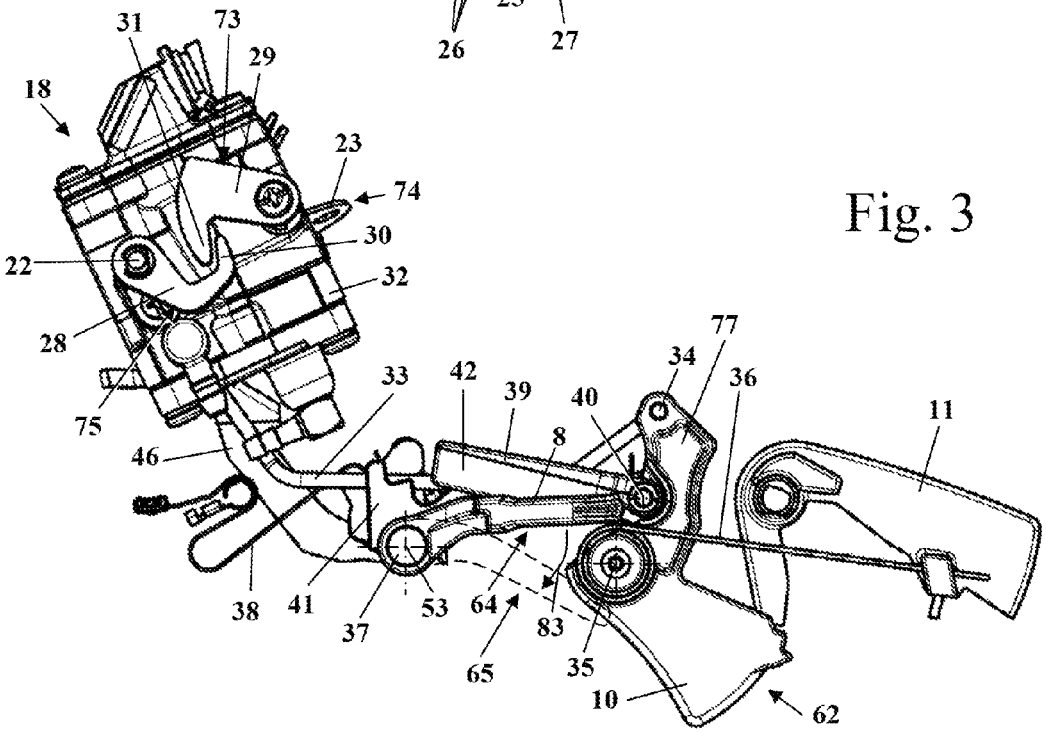
FIG. 3 is a side view of carburetor, operating mode selector, and throttle trigger of the motor chain saw of FIG. 1 in operating position of the operating mode selector and idle position of the throttle trigger.

As shown in FIG. 3, the carburetor 18 has a first coupling lever 28 that is connected fixedly to the throttle shaft 22 as well as a second coupling lever 29 that is fixedly connected to the choke shaft 24. In FIG. 3, the first coupling lever 28 is arranged in an idle position 75 and the second coupling lever 29 in a non-actuated position 73. On the first coupling lever 28, a blocking contour 30 is formed which is hook-shaped. In the position illustrated in FIG. 3 of the coupling levers 28 and 29, the blocking contour 30 engages from behind a blocking contour 31 of the second coupling lever 29. When the second throttle element 23 is pivoted from the illustrated non-actuated position 74 in the direction of the throttling position 67 illustrated in FIG. 2, the blocking contour 31 engages the blocking contour 30. As long as the first coupling lever 28 is in its idle position 75, the second throttle element 23 can thus not be pivoted into its throttling position 67.

FIG. 3 shows the throttle trigger 10 in idle position 62. The throttle trigger 10 is not actuated in this position. The throttle trigger lock 11 is not actuated in the illustration of FIG. 3. A spring 36 is acting on the throttle trigger 10 and is forcing the throttle trigger 10 in the direction of its idle position 62. The throttle trigger 10 is pivotably supported about pivot axis 35. The throttle trigger 10 has an arm 77 which extends away from the pivot axis 35; a throttle linkage 33 engages the arm 77 at an engagement (suspension) means 34. The throttle linkage 33 acts on the throttle shaft 22.

FIG. 3 shows the operating mode selector 8 in an operating position 64. For selecting a start position 65, illustrated in FIG. 3 in dashed lines, the operating mode selector 8 must be pivoted in the direction of arrow 83 by the operator. The operating mode selector 8 is secured on bearing shaft 37 that is pivotably supported about pivot axis 53. An actuating part 41 which interacts with restoring element 39 is secured on the bearing shaft 37. The restoring element 39 is supported pivotably on arm 77 of the throttle trigger 10 about pivot axis 40 and is resting on the actuating part 41. FIG. 3 shows also a lateral guide 42 of the restoring element 39. A contact spring 38 is acting on the bearing shaft 37 and short circuits ignition of the internal combustion engine 12 as a function of the position of the bearing shaft 37. In the operating position 64 of the operating mode selector 8 and of the bearing shaft 37 shown in FIG. 3, the contact spring 38 does not short-circuit the ignition. There is also an actuating lever 46 arranged on the bearing shaft 37. The bearing shaft 37 is advantageously monolithically formed together with the operating mode selector 8, the actuating part 41, and the actuating lever 46.

Figure 4:
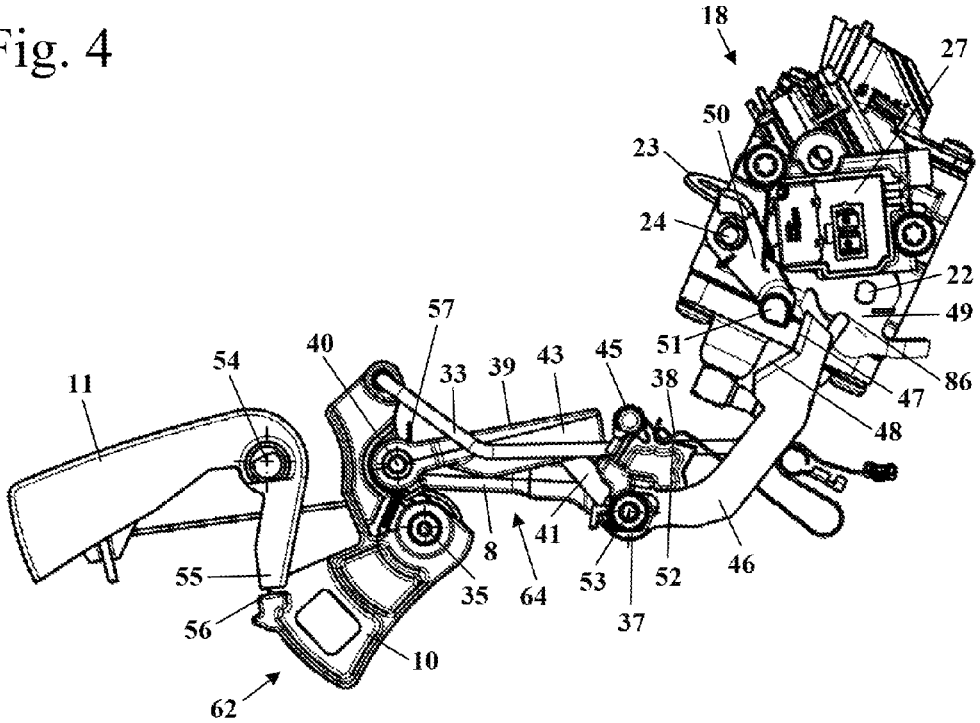
FIG. 4 is a side view of the opposite side of carburetor, operating mode selector, and throttle trigger of the motor chain saw of FIG. 1 in operating position of the operating mode selector and idle position of the throttle trigger.

FIG. 4 shows the arrangement illustrated in FIG. 3 from the opposite side, in FIG. 4 to the rear. On the restoring element 39 a second lateral guide 43 is visible. The lateral guides 42 and 43 engage the actuating part 41 that projects into the space between the two lateral guides 42 and 43. The restoring element 39 is an elongate lever which in cross-section is approximately U-shaped. As shown in FIG. 4, a spring 57 is acting on the restoring element 39 and forces the restoring element 39 against the actuating part 41. It can also be provided that the restoring element 39 is resting only as a result of the force of gravity on the actuating element 41. The throttle trigger lock 11 is pivotably supported about pivot axis 54. In the position indicated in FIG. 4, which is the non-actuated position, a locking section 55 of the throttle trigger lock 11 is in the pivot path of a locking contour 56 of the throttle trigger 10. Accordingly, the throttle trigger 10 cannot be actuated when the throttle trigger lock 11 is not actuated. As is also shown in FIG. 4, the throttle linkage 33 engages (is suspended from) a suspension element 86 on a throttle actuating lever 49. The throttle actuating lever 49 is fixedly connected to the throttle shaft 22 and is arranged on the side of the carburetor housing 32 that is opposite the coupling levers 28 and 29. By means of the throttle linkage 33 and the throttle actuating lever 49, the throttle shaft 22 of the throttle element 21 is pivoted by means of the throttle trigger 10. On the choke shaft 24 a choke actuating lever 50 is fixedly secured. The choke actuating lever 50 is arranged on the side of the carburetor housing 32 on which also the throttle actuating lever 49 is arranged. The choke actuating lever 50 has a bolt 51 which, upon adjustment of the operating mode selector 8 into the start position 65 (FIG. 3), is interacting with contact surfaces 47 and 48 of the actuating lever 46. In the operating position 64 of the operating mode selector 8 and of the bearing shaft 37, as illustrated in FIG. 4, the actuating lever 46 has a spacing relative to the bolt 51.

As also shown in FIG. 4, on the bearing shaft 37 a contact contour 52 for the contact spring 38 is formed. In the operating position 64 of the bearing shaft 37 illustrated in FIG. 4, the contact spring 38 is resting on the contact contour 52 such that it exerts torque about the bearing shaft 37 which is counteracting the actuating direction of the operating mode selector 8 indicated in FIG. 3 by arrow 83. The arrow 83 corresponds in this context to the actuating direction of the operating mode selector 8 from the operating position 64 into the start positions 65. The contact spring 38 defines together with the contact contour 52 a locking position for the bearing shaft 37. As also shown in FIG. 4, on the contact contour 52 a short-circuiting contact 45 is arranged. When the operating mode selector 8 is actuated from the operating position 64 in the opposite direction relative to the arrow 83, the contact spring 38 will contact the short-circuiting contact 45 and therefore short-circuit the ignition of the internal combustion engine 12. Accordingly, the internal combustion engine 12 can be switched off. In FIG. 4, there is also illustrated a housing of the valve 27 of the carburetor 18.

Figure 5:
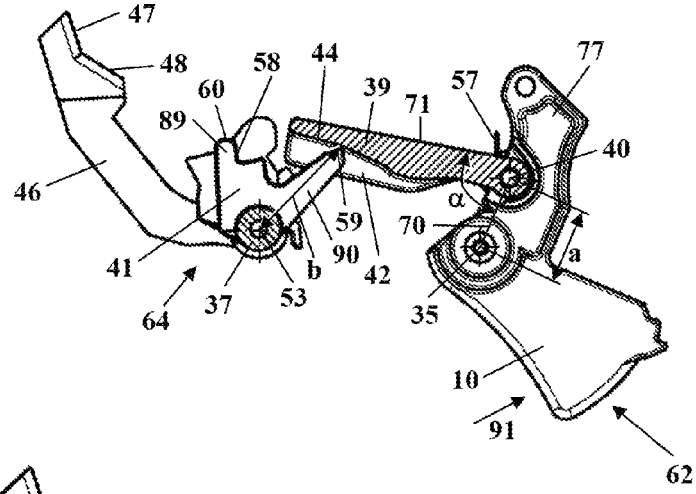
FIG. 5 is a section view of the throttle trigger and bearing shaft of the operating mode selector in the position illustrated in FIG. 3.
Figure 6:
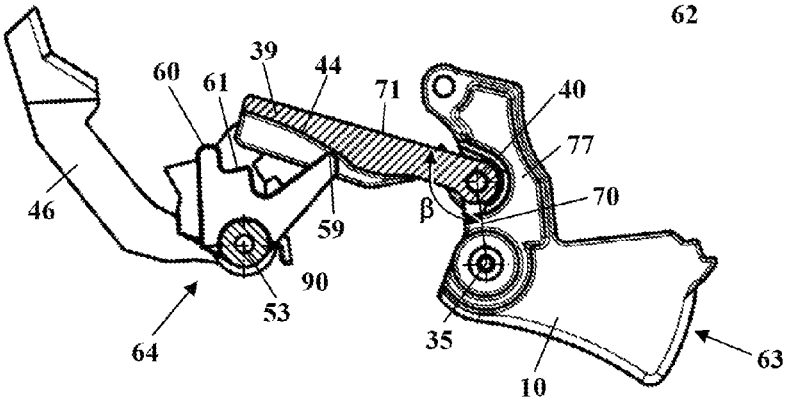
FIG. 6 is a section illustration in accordance with FIG. 5 in full throttle position of the throttle trigger.
Figure 7:
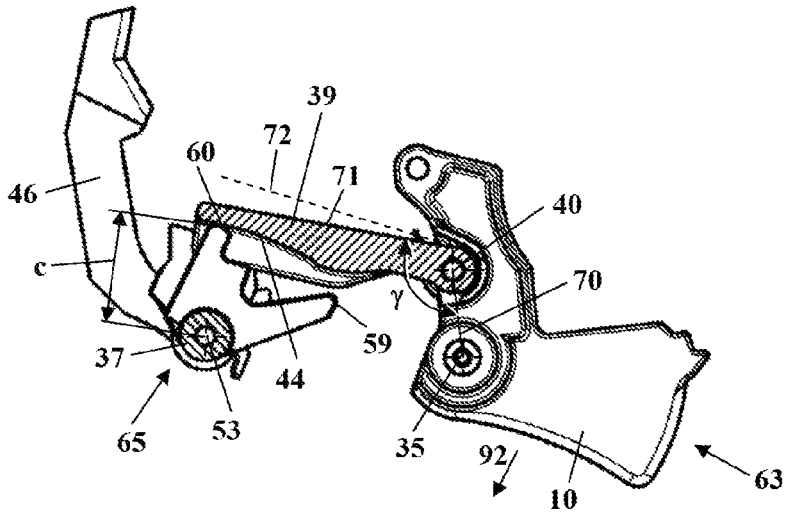
FIG. 7 is a section illustration of the arrangement of FIG. 6 in the start position of the operating mode selector.

FIGS. 5 to 7 show the arrangement of throttle trigger 10, restoring element 39, and bearing shaft 37 upon adjustment of the throttle elements 21 and 23 into the throttling positions 66 and 67. FIG. 5 shows the arrangement in the idle position 62 of the throttle trigger 10 and in the operating position 64 of the bearing shaft 37. Between the lateral guides 42 and 43 (FIG. 4), the restoring element 39 has a contact surface 44 which is contacted by a deflecting section 59 of the actuating part 41. As shown in FIG. 5, the actuating part 41 has two arms 89, 90. The two arms 89 and 90 extend away from the pivot axis 53 of the bearing shaft 37 in outward direction. On the end face of the arm 89, a contact section 60 is formed. As shown in FIG. 7, the contact section 60 has relative to the pivot axis 53 a spacing c. On the outwardly projecting end face of the arm 90, the deflecting section 59 is formed. The deflecting section 59 has relative to the pivot axis 53 a spacing b which is significantly greater than the spacing c (FIG. 7). On the lateral surface of the arm 89 which is facing the restoring element 39 in the position illustrated in FIG. 5, a restoring section 58 is formed which will be explained in more detail in the following. A support section 61 adjoins the restoring section 58 and is illustrated in FIG. 6. The support section 61 and the restoring section 58 form a step.

As also shown in FIG. 5, the pivot axis 40 of the restoring element 39 and the pivot axis 35 of the throttle trigger 10 have a spacing a relative to each other. The spring 57 forces the restoring element 39 against the deflecting section 59. The topside 71 of the restoring element 39 which is facing away from the deflecting section 59 is positioned relative to a connecting line 70 which connects the pivot axis 35 and 40 with each other at an angle $\alpha$. In the embodiment, the angle $\alpha$ in the arrangement of FIG. 5, i.e., when the throttle trigger 10 is in idle position 62 and the bearing shaft 37 in operating position 64, is somewhat smaller than 90°.

For selecting the throttling positions 66, 67 of the throttle elements 21 and 23, first the throttle trigger 10 must be pivoted into the full throttle position 63 which is illustrated in FIG. 6. For this purpose, the throttle trigger 10 is pivoted in the direction of arrow 91 in FIG. 5. As the throttle trigger 10 is pivoted, the contact surface 44 of the restoring element 39 glides across the deflecting section 59. Upon doing so, the restoring element 39 pivots relative to the throttle trigger 10 about pivot axis 40. The angle that is defined between the connecting line 70 and the topside 71 of the restoring element 39 is enlarged as the throttle trigger 10 pivots. In the full throttle position 63 of the throttle trigger 10 and in operating position 64 of the bearing shaft 37, the connecting line 70 is positioned relative to the topside 71 at an angle $\beta$ which is significantly greater than the angle $\alpha$. In the embodiment, the angle $\beta$ is greater than 90°. In the full throttle position 63, the contact surface 44 is resting on the deflecting section 59.

In FIG. 6, the bearing shaft 37 is in operating position 64. When the bearing shaft 37 is pivoted from the operating position 64 illustrated in FIG. 6 by actuation of the operating mode selector 8 into the start position 65, the deflecting section 59 is no longer in contact with contact surface 44. The deflecting section 59 lifts off the contact surface 44 of the restoring element 39. Upon pivoting of the bearing shaft 37 into the start position, the contact section 60 is moved into the area of the restoring element 39. As soon as the deflecting section 59 lifts off the contact surface 44, the restoring element 39 pivots as a result of the force of the spring 57 (FIG. 5) in the direction toward the actuating part 41. The restoring element 39 contacts the contact section 60 and is secured by the contact section 60 in the position illustrated in FIG. 7. In this position, the topside 71 is positioned relative to the connecting line 70 at an angle $\gamma$ that is smaller than the angle $\beta$. In FIG. 7, the position of the topside 71 in the position shown in FIG. 6 is indicated with a dashed line 72. The throttle trigger 10 is still in the full throttle position 63 and is held in this position by the operator.

Figure 8:
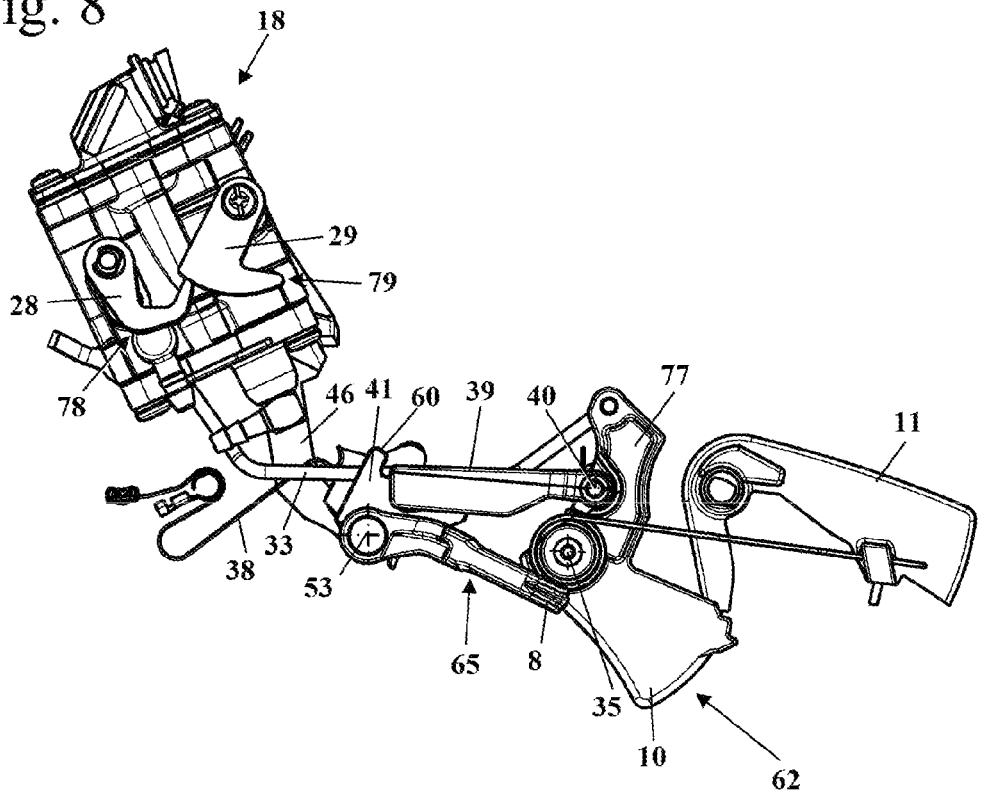
FIG. 8 is a side view of the arrangement of FIG. 3 in start position of the operating mode selector and in idle position of the throttle trigger.

After the operating mode selector 8 has been moved into its start position 65, the operator can let go of the throttle trigger 10. Accordingly, the throttle trigger 10 moves back in the direction of arrow 92 in FIG. 7 until it reaches the idle position 62 which is shown in FIG. 8. The throttle trigger 10 can return into the idle position 62 even though the first throttle element 21 is in the throttling position 66 because the suspension element 86 where the throttle linkage 33 engages the throttle actuating lever 49 is designed as a slot, as shown in particular in FIG. 11. Upon adjustment of the operating mode selector 8 into the start position 65, the actuating lever 46 actuates the bolt 51 on the choke actuating lever 50 (FIG. 4). Accordingly, the second coupling lever 29 which is fixedly connected to the choke shaft 24 is pivoted also and is moved into the start position 79 shown in FIG. 8. When the throttle trigger 10 is released from the full throttle position 63 (FIG. 7) after the second coupling lever 29 has been moved into its start position 79, the first coupling lever 28 pivots back until it contacts the coupling lever 29 in the start position 78 of the coupling lever 28.

Figure 9:
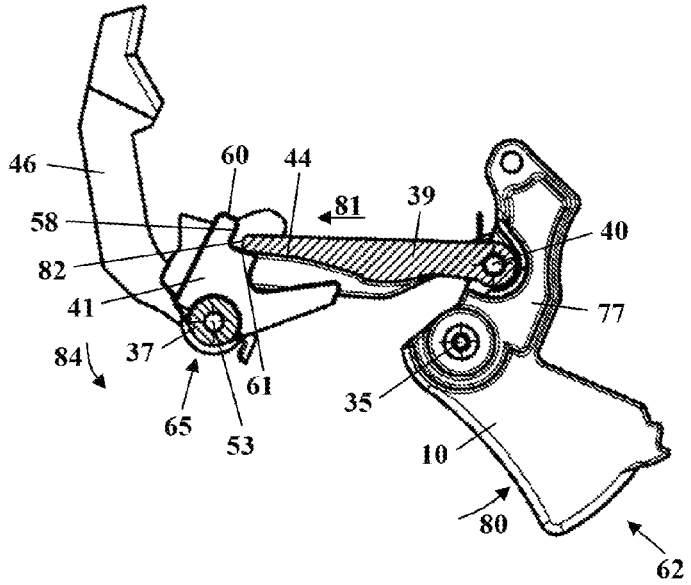
FIG. 9 is a section of the throttle trigger and bearing shaft of the operating mode selector in the position of FIG. 8.

FIG. 9 shows the throttle trigger 10 and the bearing shaft 37 in the position shown in FIG. 8. After the throttle trigger 10 has been released, the throttle trigger 10 has returned from the full throttle position 63 (FIG. 7) into the idle position 62 (FIGS. 8 and 9). Upon return of the throttle trigger 10 the restoring element 39 has slipped off the contact section 60 and is now supported on the support section 61. The restoring element 39 has an actuating surface 82 which is provided on the end face of the restoring element 39 in the illustrated embodiment. The actuating surface 82 is positioned in the position illustrated in FIG. 9 adjacent to the restoring section 58. When the throttle trigger 10 is moved from the position that is shown in FIG. 9 for bearing shaft 37 and throttle trigger 10 in the direction of arrow 80 in the direction toward its full throttle position 63 (FIG. 7), the restoring element 39 is moved in the direction of arrow 81 in FIG. 9 so that the actuating surface 82 contacts the restoring section 58 and the bearing shaft 37 is pivoted in the direction of arrow 84. Accordingly, the locking action of the bearing shaft 37 with the contact spring 38 in the start position 65 is released. The arrow 84 corresponds to the release direction of the bearing shaft 37, i.e., the adjustment of the operating mode selector 8 from the start position 65 (FIG. 9) into the operating position 64 (FIGS. 5 and 6).

Figure 10:
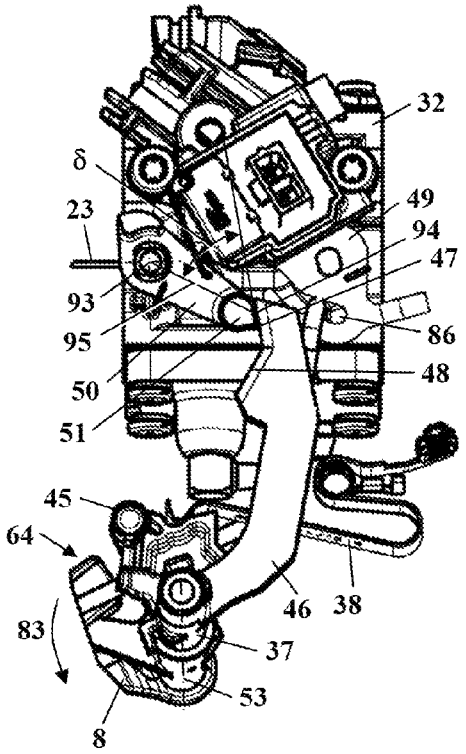
FIG. 10 is a side view of carburetor and bearing shaft of the operating mode selector in operating position of the operating mode selector.
Figure 11:
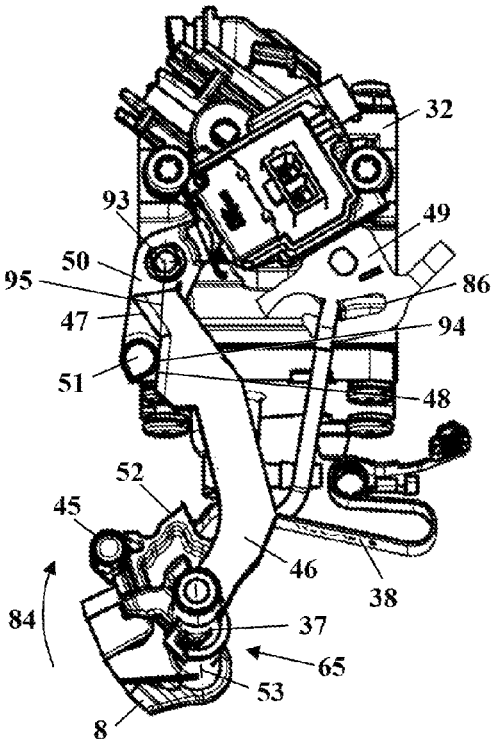
FIG. 11 is a side view in accordance with FIG. 10 in start position of the operating mode selector.

FIGS. 10 and 11 show the contact of the bolt 51 on the contact surfaces 47 and 48 upon movement of the operating mode selector 8 from the operating position 64 (FIG. 4) into the start position 65. During the pivoting action of the operating mode selector 8 in the direction of the arrow 83, the bolt 51 first contacts the first contact surface 47. In doing so, the bolt 51 is resting at contact point 94 of the contact surface 47, wherein the position of this contact point 94 continuously changes upon pivoting. The choke shaft 24 is pivotably supported about pivot axis 93. The connecting line 95 between the pivot axis 93 and the contact point 94 is positioned relative to the contact surface 47 at an angle δ that is smaller than 60°, preferably smaller than 50°. The contact surface 47 is advantageously oriented such that the angle δ is reduced to 0° while the bolt 51 is still resting on the contact surface 47. As indicated in FIG. 1, the contact of the bolt 51 changes from the first contact surface 47 over to the second contact surface 48. In the start position 65 for the bearing shaft 37 which is illustrated in FIG. 11, the bolt 51 is resting on the contact surface 48. In the position of FIG. 10, in which the bolt 51 is contacting the contact surface 47, the contact surface 48 is approximately perpendicularly oriented to the connecting line 95. In the position of FIG. 11, the connecting line 95 is approximately parallel to the contact surface 48. Upon movement of the contact point 94 from the first contact surface 47 onto the second contact surface 48, a beneficial orientation of the contact surface 47, 48 relative to the pivot axis 93 can be achieved, respectively. At the same time, the contact point 94 is always positioned such that a self-locking action of the system is prevented.

In the start position 65 of the bearing shaft 37 illustrated in FIG. 11, the contact spring 38 is acting on the contact contour 52 in a direction which is opposite to the arrow 84, i.e., is counteracting the release action. The bearing shaft 37 is thus locked by the contact spring 38 in the start position 65. The second throttle element 23 is secured by the locking action and the actuating lever 46 in its throttling position 67 (FIG. 2). By the locking action of the bearing shaft 37, the actuating lever 46, and the coupling lever 29, the coupling lever 28 is secured in its throttling position 66 and thus also the first throttle element 21. When the locking action of the bearing shaft 37 is released, the bearing shaft 37 with the actuating lever 46 returns into the operating position 64. The second throttle element 23 can pivot back into its non-actuated position 74. Accordingly, the coupling element 29 is moved out of the pivot area of the coupling element 28. As a result of actuation of the throttle trigger 10 for release of the locking action, the coupling element 28 moves away from the coupling element 29 at the same time.

The specification incorporates by reference the entire disclosure of German priority document 10 2013 009 154.3 having a filing date of May 31, 2013.

While specific embodiments of the invention have been shown and described in detail to illustrate the inventive principles, it will be understood that the invention may be embodied otherwise without departing from such principles.

What is claimed is:

1. A hand-held power tool comprising:

an internal combustion engine comprising:

a throttle trigger adjustable between an idle position and a full throttle position;

an operating mode selector adjustable between an operating position and a start position;

an intake passage;

at least one throttle element arranged in the intake passage, wherein the at least one throttle element, in the start position of the operating mode selector, is in a throttling position, wherein the at least one throttle element is secured in the throttling position by a locking action, wherein the locking action is released upon actuation of the throttle trigger from the idle position in the direction toward the full throttle position;

a restoring element coupled permanently to the position of the throttle trigger, wherein the restoring element, when the operating mode selector is in the start position, wherein, in the start position, the at least one throttle element is secured by the locking action, and when the throttle trigger is moved by a force applied by an operator for releasing the locking action, acts on the operating mode selector and restores the operating mode selector from the start position into the operating position by the force applied by the operator on the throttle trigger, wherein the restoring element applies the force applied by the operator on the operating mode selector.

2. The power tool according to claim 1, wherein the restoring element interacts with an actuating part that is connected to the operating mode selector.

3. The power tool according to claim 2, wherein the restoring element is supported pivotably on the throttle trigger and is resting on the actuating part.

4. The power tool according to claim 2, wherein the restoring element is supported by a spring action and forced by a spring force of the spring action against the actuating part.

5. The power tool according to claim 2, wherein the actuating part comprises a restoring section, wherein the restoring element, when the throttle trigger is pivoted from the idle position in a direction toward the full throttle position, is acting on the restoring section and restores the operating mode selector into the operating position.

6. The power tool according to claim 5, wherein, when the throttle trigger is pivoted from the full load position into the idle position while the operating mode selector is in the start position, the restoring element is pivoted and the restoring section is moved into a movement path of the restoring element, said movement path followed by the restoring element when the throttle trigger moves from the idle position into the full throttle position.

7. The power tool according to claim 2, wherein the actuating part has a deflecting section, said deflecting section resting in the operating position of the operating mode selector on the restoring element and deflecting the restoring element out of a movement path of the actuating part when the throttle trigger is moved from the idle position in the direction toward the full throttle position.

8. The power tool according to claim 7, wherein the deflecting section is lifted off the restoring element when the operating mode selector is moved from the operating position into the start position.

9. The power tool according to claim 2, wherein the actuating part has a contact section that deflects the restoring element when the throttle trigger is in the full throttle position and the operating mode selector is in the start position, wherein the restoring element slips off the contact section when the throttle trigger is pivoted into the idle position.

10. The power tool according to claim 1, wherein the internal combustion engine comprises at least one lateral guide that interacts with and guides the restoring element.

11. The power tool according to claim 1, wherein a first throttle element and a second throttle element of said at least one throttle element are provided in the intake passage, wherein the first throttle element and the second throttle element are acted on and moved by the operating mode selector into a throttling position, respectively.

12. The power tool according to claim 11, wherein the first throttle element is connected to a first coupling lever and wherein the second throttle element is connected to a second coupling lever, wherein in the start position of the operating mode selector the first and second coupling levers are locked with each other and the first and the second throttle elements are secured in the throttling position, respectively.

13. The power tool according to claim 11, wherein the throttle trigger acts on the first throttle element and wherein the operating mode selector acts on the second throttle element.

14. The power tool according to claim 13, wherein the operating mode selector acts by an actuating lever onto the second throttle element, wherein the actuating lever has a first contact surface and a second contact surface, and wherein the actuating lever, when the operating mode selector is pivoted from the operating position into the start position, is first acting through the first contact surface on the second throttle element and then through the second contact surface on the second throttle element.

15. The power tool according to claim 1, further comprising a throttle shaft and a throttle actuating lever mounted on the throttle shaft, wherein the at least one throttle element is pivotably supported by the throttle shaft, wherein the throttle trigger is operatively connected to a throttle linkage and the throttle linkage is operatively connected to the throttle actuating element, wherein the throttle trigger acts on the at least one throttle element through the throttle linkage and the throttle actuating element to pivot the at least one throttle element, wherein the restoring element is pivotably secured on the throttle trigger.

16. A hand-held power tool comprising:

an internal combustion engine comprising:

a housing;

a throttle trigger pivotably supported on the housing about a first pivot axis and adjustable between an idle position and a full throttle position;

an operating mode selector adjustable between an operating position and a start position;

an intake passage;

at least one throttle element arranged in the intake passage, wherein a pivot movement of the throttle trigger from the idle position into the full throttle position causes an adjustment of the at least one throttle element from an idle position of the at least one throttle element into a throttling position, wherein the at least one throttle element, in the start position of the operating mode selector, is in the throttling position, wherein the at least one throttle element is secured in the throttling position by a locking action, wherein the locking action is released upon actuation of the throttle trigger from the idle position in the direction toward the full throttle position;

a restoring element coupled permanently to the position of the throttle trigger, wherein the restoring element, when the throttle trigger is moved for releasing the locking action, acts on the operating mode selector and restores the operating mode selector from the start position into the operating position;

wherein the restoring element is pivotably supported on the throttle trigger about a second pivot axis, wherein the second pivot axis is spaced apart from the first pivot axis by a spacing, and wherein the second pivot axis, when the throttle trigger pivots about the first pivot axis, moves together with the throttle trigger about the first pivot axis.

* * * * *